United States Patent [19]

Kristof

Best Available Copy

[11] 4,289,945

[45] Sep. 15, 1981

[54] ENERGY TRANSMISSION AND DISTRIBUTION SYSTEM FOR A MICROWAVE OVEN

[75] Inventor: Mark J. Kristof, Marion Township, Marion County, Ohio

[73] Assignee: Whirlpool Corporation, Benton Harbor, Mich.

[21] Appl. No.: 85,893

[22] Filed: Oct. 17, 1979

[51] Int. Cl.[3] ..... H05B 6/74

[52] U.S. Cl. ..... 219/10.55 F; 219/10.55 R

[58] Field of Search ..... 219/10.55 F, 10.55 R, 219/10.55 B, 10.55 M

[56] References Cited

U.S. PATENT DOCUMENTS

| | | | |
|---|---|---|---|
| 3,211,880 | 10/1965 | Johnson | 219/10.55 F |
| 4,133,997 | 1/1979 | Thuleen | 219/10.55 F |
| 4,159,406 | 6/1979 | Tate et al. | 219/10.55 F |

FOREIGN PATENT DOCUMENTS

| | | | |
|---|---|---|---|
| 52-23744 | 2/1977 | Japan | 219/10.55 F |

*Primary Examiner*—Arthur T. Grimley
*Attorney, Agent, or Firm*—Wegner, Stellman, McCord, Wood & Dalton

[57] ABSTRACT

An energy transmission and distribution system for use in a microwave oven wherein a waveguide member is provided for guiding microwave energy from a generator to an inlet opening to the oven cavity. An impedance matching device is mounted within the waveguide for matching the impedance of the oven cavity and waveguide to that of the generator. A deflector shield is mounted within the cavity adjacent the inlet opening for deflecting microwave energy passed through the inlet opening and effectively preventing direct illumination of the cavity by the microwave energy. A rotating stirrer is mounted within the cavity adjacent the inlet opening and adjacent the deflector shield and cooperates with the deflector shield to provide improved uniform distribution of the microwave energy in the oven cavity.

16 Claims, 4 Drawing Figures

Fig. 1
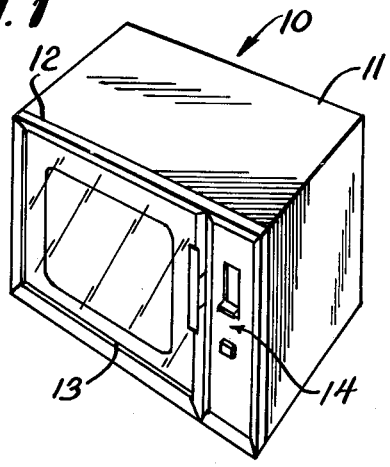
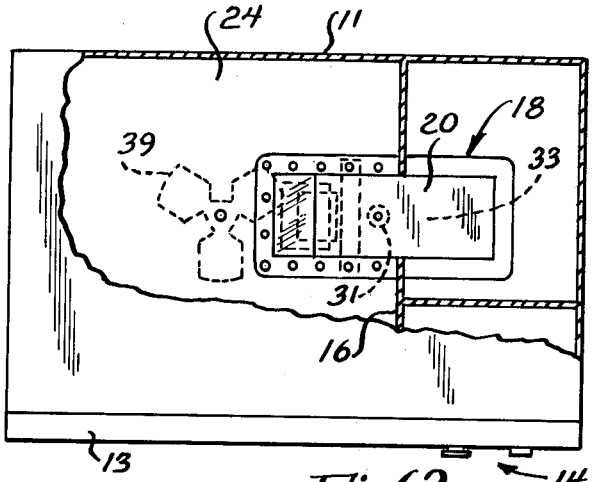
Fig. 2
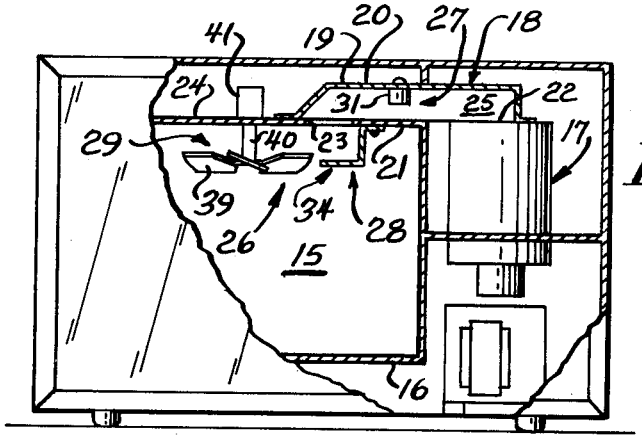
Fig. 3
Fig. 4
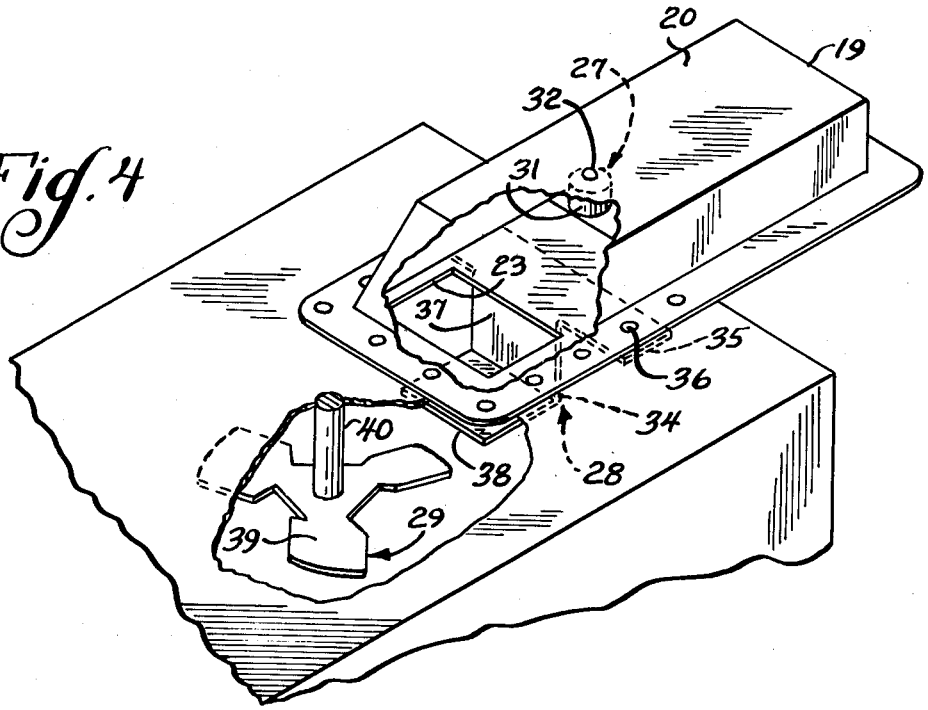

ENERGY TRANSMISSION AND DISTRIBUTION SYSTEM FOR A MICROWAVE OVEN

BACKGROUND OF THE INVENTION

1. Field of the Invention

This invention relates to microwave oven structures and in particular to means for providing microwave energy from the generating means to the oven cavity.

2. Description of the Background Art

In the conventional microwave oven, a magnetron or the like is provided for generating microwave energy for use in heating objects disposed within an associated oven cavity. A waveguide is provided for conducting the microwave energy from the generating means through an inlet opening in the wall of the oven cavity.

In one form of microwave oven, the waveguide is tuned. One example of such a tuned waveguide is illustrated in U.S. Pat. No. 3,867,605 of Allan Yee. As shown therein, the tuner comprises a waveguide fastener secured to the bottom wall of the waveguide as by conventional rivet means.

It is further conventional to provide a stirrer within the oven cavity for distributing the microwave energy delivered through an inlet opening. The stirrer conventionally is arranged to rotate adjacent the inlet opening and in the above-identified Yee patent, a motor driven stirrer is provided, including a center disc having attached thereto a stirrer ring with projecting portions so as to define a capacitor with eight rotating antennae.

Peter H. Smith shows, in U.S. Pat. No. 3,300,615, an electronic oven having a baffle plate within the oven adjacent the inlet opening functioning to spread the microwave energy substantially evenly around the periphery of the interior of the oven.

In U.S. Pat. No. 3,748,423, Duane B. Haagensen shows a microwave oven having a plate provided to confine the microwave power to a more restricted opening to effect a more complete diversion of energy. The deflector includes a shaft that permits a swinging movement of the plate. Means are provided connected to the door of the device to cause the plate to be advanced into the waveguide when the door is opened and to be withdrawn therefrom when the door is closed.

Stewart C. Johnson shows, in U.S. Pat. No. 3,211,880, a microwave oven wherein a deflector is provided at an angle to the inlet opening.

Franklin J. Smith shows, in U.S. Pat. No. 3,446,929, a microwave apparatus wherein the waveguide is provided with a plurality of slots to provide for distributed injection of energy from a generator into the heating space. A baffle is mounted near the central portion of the tunnel for coupling the microwave energy into the tunnel.

Werner Golombek et al show a waveguide structure in U.S. Pat. No. 3,522,550, wherein a tuning stub is provided which, by suitable adjustment, moves the mean operating point of the system from the center of the generator diagram to the region of high efficiency in high output power.

In U.S. Pat. No. 3,965,325, Kazumi Hirai shows a microwave oven utilizing a microwave energy reflector which directs the microwave energy onto a fan for conducting cooling air through the oven and which apparently directs the microwaves in a disperse manner into the oven chamber.

Mahlon W. Slocum et al show, in U.S. Pat. No. 4,035,749, a microwave tuning screw assembly mounted in the opening of the oven cavity or waveguide to provide positive shorting at an inner wall of the cavity or waveguide.

SUMMARY OF THE INVENTION

The present invention comprehends an improved microwave oven structure including means providing improved energy transmission and distribution.

The invention comprehends the provision of impedance matching means within the waveguide for matching the impedance of the cavity and waveguide to the generating means. A shield means is provided within the oven cavity adjacent the inlet opening thereto for deflecting microwave energy passed from the waveguide through the inlet opening and effectively preventing direct illumination of the cavity by the microwave energy delivered from the waveguide.

A rotating stirrer means is provided within the cavity adjacent the inlet opening and adjacent the deflector for cooperating with the impedance matching means and deflector shield means in causing improved transmission and uniform distribution of the microwave energy in the oven structure.

The impedance matching means may comprise a stub means mounted to the waveguide member.

The deflector shield may comprise a deflector plate fixed transversely to the inlet opening. In the illustrated embodiment, the deflector plate includes a first portion extending from the oven cavity wall means adjacent the inlet opening and a second portion carried by the first portion to extend transversely to and in inwardly spaced relationship to the inlet opening.

The waveguide impedance matching means is arranged to provide optimum power and efficiency of the microwave energy generating means. The novel cooperation of the impedance matching means with the deflector shield means and stirrer means provides an improved, highly efficient uniformly distributed delivery of the microwave energy in an extremely simple and economical manner.

BRIEF DESCRIPTION OF THE DRAWING

Other features and advantages of the invention will be apparent from the following description taken in connection with the accompanying drawing wherein:

FIG. 1 is a perspective view of a microwave oven having an energy transmission and distribution system embodying the invention;

FIG. 2 is a top plan view of a microwave oven with a portion broken away for facilitated illustration of the energy transmission and distribution system of the present invention;

FIG. 3 is a front elevation of a microwave oven with a portion broken away and partially in section, illustrating the improved energy transmission and distribution system; and FIG. 4 is a fragmentary perspective view of the system embodying the invention.

DESCRIPTION OF THE PREFERRED EMBODIMENT

In the exemplary embodiment of the invention as disclosed in the drawing, a microwave oven generally designated 10 is shown to comprise an outer cabinet 11 having a front opening 12 selectively closed by a hinged door 13. Suitable controls 14 are provided externally accessible for controlling the operation of the oven in heating objects placed in an oven cavity 15 (FIG. 2) defined by a cavity wall member 16 inwardly of the cabinet opening 12.

Microwave energy is developed in the oven 10 by means of a conventional generating means 17 which may comprise a conventional magnetron microwave energy generating means. The microwave energy is delivered from the generating means 17 to a waveguide 18 defined by a waveguide member 19 having a top wall 20 and a bottom wall 21 comprising a portion of a top wall 24 of the oven cavity wall member 16. The bottom wall defines a rear opening 22 for receiving the microwave energy from generating means 17. The front portion of the waveguide opens through an inlet opening 23 in the top wall 24 for delivering the microwave energy delivered from generator 17 through a microwave path 25 defined by the interior of the microwave guide 18 and through the inlet opening 23 into oven cavity 15.

The present invention comprehends the provision of an improved energy transmission and distribution system generally designated 26 for providing improved efficiency in the transfer of the microwave energy from generating means 17 to the oven cavity 15 as shown in FIGS. 2, 3 and 4. More specifically, system 16 includes three cooperating means which effectively maximize the efficiency in effecting the heating of objects in the oven cavity. The efficiency improvement means 26 includes an impedance matching means generally designated 27, a fixed deflector means 28, and a movable deflector means 29.

The impedance matching means 27 comprises a metal waveguide tuning stub 31 secured to the wall 20 of the waveguide member 19 by a suitable means such as rivet 32. The stub 31 comprises a cylindrical member depending from the top wall transversely to the waveguide path 25 and, as seen in FIG. 2, is located substantially on the longitudinal centerline 33 of the waveguide. As shown in FIG. 3, the stub extends approximately one-half the height of the waveguide path 25 and is sized and located accurately so as to locate the impedance locus of the cavity looking into the waveguide longitudinally along the centerline 33 from the magnetron end of the waveguide for optimum power and efficiency of operation of the generating means 17.

The tuning stub provides a reactive impedance substantially without a resistance component.

As shown in FIG. 3, the impedance matching means 27 is disposed intermediate the rear opening 22 of the waveguide and the inlet opening 23. The fixed deflector means 28, as shown in FIG. 2, is defined by an L-shaped plate member 34 having a mounting flange 35 secured to the oven cavity wall 24 by suitable means such as rivets 36 which may further serve to secure the waveguide to the top wall 24, as illustrated in FIG. 4.

Plate member 34 includes a first portion 37 extending downwardly from the wall 24 generally perpendicularly thereto, and a second portion 38 carried at the lower end of the first portion 37 to extend generally horizontally transversely below and in spaced relationship to the inlet opening 23. Thus, as shown in FIGS. 3 and 4, the fixed deflector member 28 effectively defines means for preventing direct illumination of the oven cavity 15 by the microwave energy delivered through the inlet opening 23 from the waveguide path 25. In the illustrated embodiment, as best seen in FIG. 2, the lateral extent of the deflector portion 38 is less than the lateral extent of the inlet opening.

As further shown in FIGS. 2, 3 and 4, the movable deflecting means 29 is defined by a paddle 39 carried on a suitable shaft 40 which may be rotated by a suitable motor 41. As shown in FIG. 3, the paddle blades are aligned flatwise generally with the horizontal extent of the fixed deflector wall member portion 38 and, thus, cooperate with the deflector wall member 34 in providing a distributed delivery of the microwave energy into the oven cavity 15 in the normal use of the microwave oven.

The invention comprehends the cooperation of the system means 27, 28 and 29 in the operation of the microwave oven to provide an unexpected improved efficiency and distribution of microwave energy in the oven. The structural elements of means 27, 28 and 29 are sized and located to provide the desired optimization of the efficiency and uniformity of distribution. Thus, improved utilization of the input energy to the generating means 17 is realized providing highly desirable conservation of energy resources in effecting the heating of objects such as food products in the microwave oven.

The foregoing disclosure of specific embodiments is illustrative of the broad inventive concepts comprehended by the invention.

I claim:

1. In a microwave oven structure having wall means defining an oven cavity and an inlet opening to said cavity, and microwave energy generating means externally of said cavity, an improved energy transmission and distribution system for delivering microwave energy from said generating means through said inlet opening into said cavity, said system comprising:

a waveguide member extending in communicating relationship from said generating means to said inlet opening;

impedance matching means within said waveguide for matching the impedance of said cavity and said waveguide to said generating means;

shield means within said cavity adjacent said inlet opening for deflecting microwave energy passed through said inlet opening into said cavity; and stirrer means within said cavity and adjacent said inlet opening and said deflector, said impedance matching means, shield means, and stirrer means being accurately sized and located for cooperatively causing effectively optimized uniform distribution of said microwave energy in said oven structure.

2. The microwave oven structure of claim 1 wherein said impedance matching means comprises stub means mounted to said waveguide member.

3. The microwave oven structure of claim 1 wherein said shield means comprises a deflector plate.

4. The microwave oven structure of claim 1 wherein said shield means comprises a deflector plate fixed transversely to said inlet opening to effectively prevent direct illumination of said cavity by said microwave energy passed through said inlet opening.

5. The microwave oven structure of claim 1 wherein said stirrer means comprise rotating means.

6. The microwave oven structure of claim 1 wherein said stirrer paddle means comprise rotating means.

7. In a microwave oven having wall means defining an oven cavity and an inlet opening to said cavity, and microwave energy generating means externally of said cavity, an improved energy transmission and distribution system for delivering microwave energy from said generating means through said inlet opening into said cavity, said system comprising:

a waveguide member defining a waveguide path extending from said generating means to said inlet opening;

fixed deflector means within said cavity adjacent said inlet opening for deflecting microwave energy passed through said inlet opening into said cavity; and movable deflector means within said cavity and adjacent said inlet opening and said fixed deflector means, said fixed deflector means cooperating with said movable deflector means and waveguide member to provide optimized coaction therebetween in providing uniform distribution of said microwave energy in said oven cavity.

8. The microwave oven structure of claim 7 wherein said fixed deflector means comprises a wall member having a first portion extending from said wall means adjacent said inlet opening and a second portion carried by said first portion to extend transversely to and in inwardly spaced relationship to said inlet opening.

9. The microwave oven structure of claim 7 wherein said fixed deflector means comprises an L-shaped wall member having a first portion extending perpendicularly from said wall means adjacent said inlet opening and a second portion carried by said first portion extend transversely to and in inwardly spaced relationship to said inlet opening.

10. The microwave oven structure of claim 7 wherein said fixed deflector means comprises a wall member having a first portion extending from said wall means adjacent said inlet opening and a second portion carried by said first portion to extend transversely to and in inwardly spaced relationship to said inlet opening, said second portion having a lateral extent less than that of the inlet opening.

11. The microwave oven structure of claim 7 wherein said fixed deflector means comprises a wall member having a first portion extending from said wall means adjacent said inlet opening and a second portion carried by said first portion to extend transversely to and in inwardly spaced relationship to said inlet opening, said movable deflector defining a blade member having a flatwise extent substantially aligned with said wall member second portion.

12. In a microwave oven having wall means defining an oven cavity and an inlet opening to said cavity, and microwave energy generating means externally of said cavity, an improved energy transmission and distribution system for delivering microwave energy from said generating means through said inlet opening into said cavity, said system comprising:

a waveguide member defining a waveguide path from said generating means to said inlet opening;

stub means mounted within said waveguide for matching the impedance of said cavity and said waveguide to said generating means; and at least two sequentially related deflector means within said cavity adjacent said inlet opening for deflecting said microwave energy passed through said inlet opening into said cavity, said stub means and deflector means being accurately sized and located for cooperatively causing effectively optimized uniform distribution of said microwave energy in said oven structure.

13. The microwave oven structure of claim 12 wherein said stub means comprises a metal member carried by the waveguide member.

14. The microwave oven structure of claim 12 wherein said stub means comprises a metal member carried by the waveguide member adjacent the inlet opening.

15. The microwave oven structure of claim 12 wherein said waveguide member defines a horizontal top wall and said stub means is mounted to said top wall to extend downwardly therefrom across said waveguide path.

16. The microwave oven structure of claim 12 wherein said stub means comprises a cylindrical member extending axially perpendicularly to the centerline of the waveguide path.

* * * * *

UNITED STATES PATENT AND TRADEMARK OFFICE

CERTIFICATE OF CORRECTION

PATENT NO. : 4,289,945

DATED : September 15, 1981

INVENTOR(S) : MARK J. KRISTOF

It is certified that error appears in the above-identified patent and that said Letters Patent are hereby corrected as shown below:

Claim 9, line 5 (column 5, line 27), after "portion" (second occurrence), insert --to--.

Signed and Sealed this

*Second* Day of *February 1982*

[SEAL]

*Attest:*

GERALD J. MOSSINGHOFF

*Attesting Officer*

*Commissioner of Patents and Trademarks*